United States Patent [19]

Lazickas

[11] Patent Number: 4,974,611

[45] Date of Patent: Dec. 4, 1990

[54] SHOE HORN AND COMB COMBINATION

[76] Inventor: Casimir M. Lazickas, 478 Potters Rd., Buffalo, N.Y. 14220

[21] Appl. No.: 354,858

[22] Filed: May 22, 1989

[51] Int. Cl.[5] ..... A45D 24/00

[52] U.S. Cl. ..... 132/148

[58] Field of Search ..... 132/219, 148

[56] References Cited

U.S. PATENT DOCUMENTS

| | | | |
|---|---|---|---|
| D. 149,393 | 4/1948 | Wheeler et al. | 132/148 |
| D. 206,206 | 11/1966 | Battagli | 132/148 |
| 764,698 | 7/1904 | Zinn | 132/148 |
| 1,025,448 | 5/1912 | Burnet | 132/148 |
| 1,832,500 | 11/1931 | Pauchek | 132/148 |

FOREIGN PATENT DOCUMENTS

| | | | |
|---|---|---|---|
| 834280 | 2/1952 | Fed. Rep. of Germany | 132/148 |
| 592059 | 7/1925 | France | 132/148 |
| 590029 | 7/1977 | Switzerland | 132/73.5 |

*Primary Examiner*—Gene Mancene
*Assistant Examiner*—Michael Lynch
*Attorney, Agent, or Firm*—Schmeiser, Morelle & Watts

[57] ABSTRACT

A combined shoe horn and comb including an end tooth forming a falciform arch for gripping the comb when using the shoe horn. A plurality of indents in the spine of the comb are oppositely disposed for convenient use with either the left or right hand.

In an alternate embodiment the shoe horn portion of the invention consists of a plurality of elongate teeth in arcuate array.

5 Claims, 3 Drawing Sheets

SHOE HORN AND COMB COMBINATION

FIELD OF THE INVENTION

Generally, this invention relates to items which combine the characteristics of a comb and a shoe horn. More specifically, the invention is a combined comb and shoe horn having special characteristics for compact carrying and easy use in either of its functional modes.

BACKGROUND OF THE INVENTION

The basic concept of combining a shoe horn and comb is known. Disclosures of such combinations exist in Pat. No. 1,025,448 issued to Burnet and Pat. No. 1,832,500 issued to Paucheck.

The need for a single product having the capabilities of both a comb and shoe horn have a substantial utility in present day life. This need is predicated upon two rather recent developments in the life styles of many individuals. First, many people, especially in cities, walk a relatively significant distance both to and from their place of employment. With greater attention being directed toward proper walking attire many people now wear a walking shoe or sneaker on their way to or from their place of employment, changing into dress shoes When they are on the job. Secondly, the ever increasing attention which is being placed upon exercise and health has resulted in a greater awareness and participation in health activities during the work week. In particular, many individuals now take lunch breaks during which they either walk, jog, or attend health spas. In both of these instances it is now common for individuals to change into and out of their shoes several times during a regular work day. For this reason, the typical shoe horn, which is generally kept in ones place of abode, is no longer sufficient and the need for a carry-along shoe horn is greater then ever. However, it is doubtful whether any significant number of individuals will go to the extent of carrying a separate shoe horn for use during the day and therefore, combining the shoe horn with a commonly used item which virtually everyone has in their possession, namely, a comb, serves a dual purpose which provides increased convenience for the user.

The combination of a shoe horn and comb is not an easy task. Although these items can be combined in a number of ways, as shown in the above named patents, this combination has yet to be made in a way which overcomes the problems inherent in such a combination. One such problem is the more general need of having each feature, the comb and the shoe horn, function as well in combination as they do when singularly composed. Furthermore, additional consideration must be given to the fact that should either feature fail the value of the combined item vanishes. This is true anywhere devices having separate characteristics, although perhaps related, are incorporated into a single unit. Many people have experienced this in other fields such as the music industry. Combined radio, cassette and record players, with built in speakers although initially popular have disappointed many individuals when one or more of the features ceases to function and the consumer viewed benefit of the combination ceases to exist. Relative to the subject invention it is clear that the feature most susceptible to breaking is generally the comb teeth. Not only does a comb with missing teeth fail to function as well, but the broken tooth may be sharp, or configured in such a way that during use ones strands of hair become engaged in the broken tooth. Furthermore, a comb with missing teeth is unacceptable simply because of the image which it portrays.

The problem of broken comb teeth is potentially exacerbated when one considers the purpose of utilizing a shoe horn. As we all know shoe horns are used to direct the foot into a relatively snug fitting shoe without breaking down the back of the shoe. While the tightness of the shoe may vary it is generally accepted that the fit must be sufficiently snug so that the heel of the foot is held in place and does not ride up and down in the shoe during use, which motion if not avoided will result in abrasions. The need for a snug fitting shoe and avoiding the break down of the back of the shoe are related in such a manner that the shoe horn in performing its function becomes wedged between the heel and the back of the shoe generally resulting in a significant amount of resistance when the user seeks to disengage the shoe horn from the work piece. When the portion of the product being held in order to remove the shoe horn includes the teeth of the comb the frequency of breakage is significantly increased. This is especially true where the user must apply a significant amount of pressure to the comb in order to prevent the relatively flat comb surface from slipping out of his hand.

Also, due to the natural greases in the hair, if one must grasp the teeth of the comb to remove the shoe horn there is a greater likelihood of slippage. The user therefore tightens his grip which tighter grip and slippage combine to commonly break the comb teeth.

Another problem encountered relates to the now wide variety of hair care implements which are available. More particularly, many individuals use not only a straight, or regular shaped comb but often they also use a different type of comb known as a lift or a pick. A pick or lift generally has less teeth which are spaced apart a greater distance then a standard comb. The teeth of the pick are also at least two to three times longer (3 to 6 inches) then standard comb teeth. However, attempting to combine the features of a standard comb, a pick and a shoe horn without sacrificing convenience in usage and in carrying the item poses a significant difficulty.

SUMMARY OF THE INVENTION

The subject invention provides an improved comb/shoe horn combination utilizing a reinforced part of the comb as a grip for removing the shoe horn after use. Considering the last tooth of the comb, the base of that tooth expands to form a smooth falciform arc which serves the additional function of a shoe horn grip. Where less effort is required to remove the shoe horn opposing depressions on the spine of the shoe horn allow the user to grip the device further from the shoe horn segment which is obviously more convenient since it requires less bending. Recognition is given to the fact that it is common to switch hands as the user applies the shoe horn first to one foot and then the other. Accordingly, the depressions located in the spine are not only angled in order to receive the hand in a comfortable gripping fashion but they are also arranged in opposing angle sets with two depressions to each set. The depressions in each set are on opposite sides of the spine for convenient usage with either hand.

In order to combine different comb types in a device having shoe horn capabilities an alternate embodiment of this invention fashions the elongate teeth of the lift comb in an arcuate array. These teeth being of a resilient material provide a dual purpose singular comb embodiment.

DETAILED DESCRIPTION OF THE DRAWINGS

Figure 1:
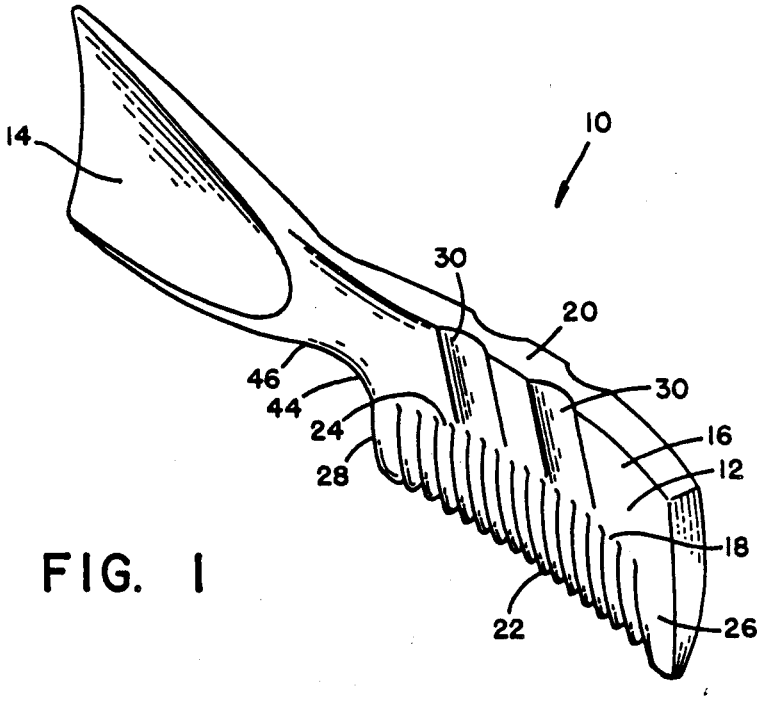
FIG. 1 is a side perspective view of the comb/shoe horn combination.
Figure 2:
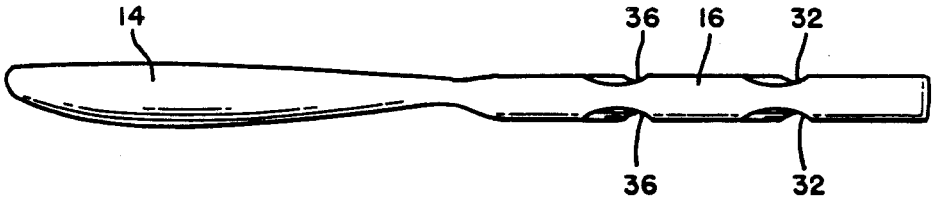
FIG. 2 is a side elevational view of the invention showing the spine.

FIG. 1 discloses the subject invention generally designated as 10 said invention including a comb portion 12 and a shoe horn portion 14.

The comb portion 12 has a spine 16 with an inside edge 18 and an outside edge 20. A row of teeth 22 extend outwardly from the inside edge 18 in parallel array. The base 24 of teeth 22 being substantially uniform with the spine 16.

Figure 3:
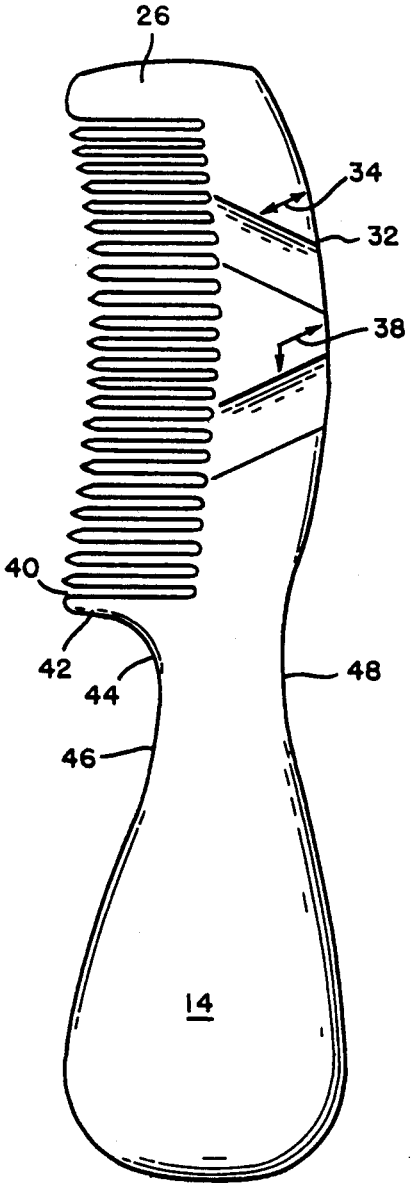
FIG. 3 is a plan view of one side of the invention.
Figure 4:
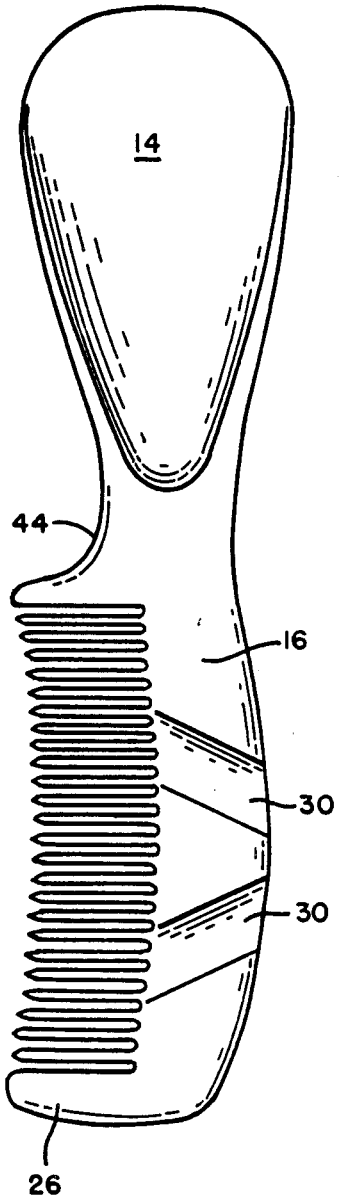
FIG. 4 is a plan view of the other side of the invention.

As shown more clearly in FIGS. 3 and 4, at one end of the spine 16 is a top tooth 26 of greater dimension then the other teeth 22. At the other end of the spine is a bottom end tooth 28 which in conjunction with the top tooth 26 form the opposite ends of the row of teeth 22.

Located in the spine 16 are two sets of depressions 30. Each depression in a set is placed at substantially the same distance along the spine but on opposite sides of the spine 16. Depression set 32 extends from the outside edge 20 of spine 16 to the inside edge 18 of spine 16 and in the preferred embodiment is at an arcuate angle 34 of substantially 71 degrees when measured from the outside edge 20 of spine 16. Depression set 36 is closer to the shoe horn 14 and forms an obtuse angle 38 of 99 degrees from the outside edge 20 of spine 16.

Figure 5:
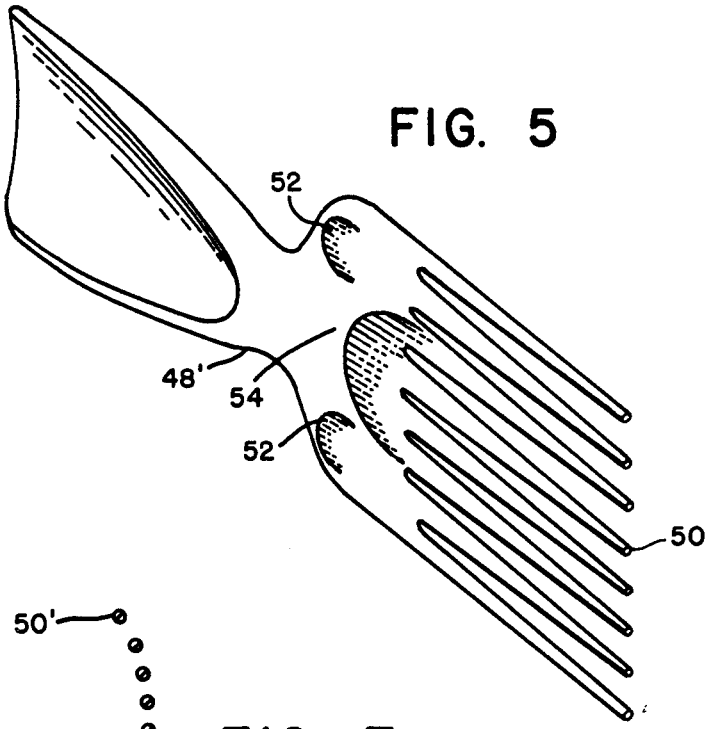
FIG. 5 is a perspective view of an alternate embodiment of the invention.

The bottom end tooth 28 has an inner surface 40 facing teeth 22 and an outer surface 42 which faces opposite teeth 22. The outer surface 42 of bottom end tooth 28 forms a smooth falciform arc 44 which serves as an additional gripping means when significant force needs to be applied to remove the shoe horn 14. The falciform arc continues outwardly to form the shoe horn edge 46. Opposite the falciform arc 44 the outside edge 20 of spine 16 draws inward toward the arc 44 thereby forming a neck segment 48 which segment is uniform with the shoe horn 14. The shoe horn 14 and the comb 12 lie in substantially the same plane. FIG. 5 discloses an alternate embodiment wherein teeth 50 are approximately 3 to 6 inches long and used in a comb commonly known as a lift or pick. In this configuration indents 52 are placed in the space 54 which narrows to form neck 48'.

Figure 7:
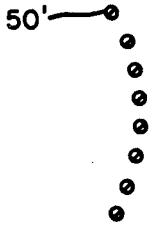
FIG. 7 is a view taken along lines 7—7 of FIG. 6.
Figure 6:
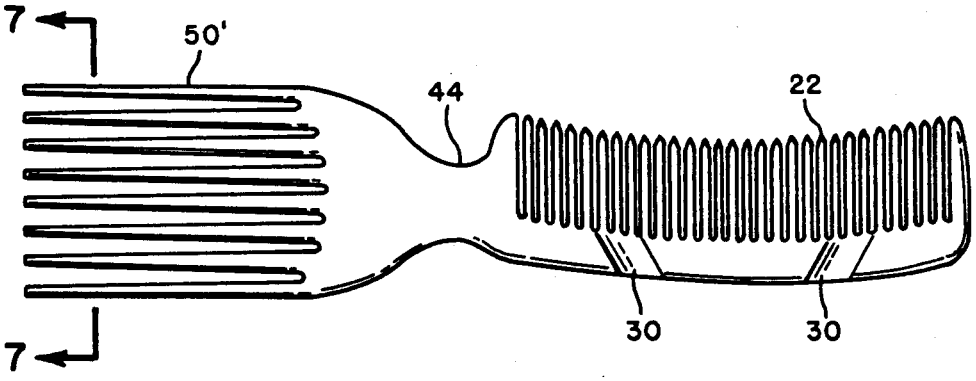
FIG. 6 is a plan view of a second alternate embodiment of the invention.

FIG. 6, is numbered with prime numbers corresponding to similar elements in the other figures, and discloses an alternate embodiment wherein the shoe horn portion 14 consists of elongate teeth 50' preferably in arcuate array as shown in FIG. 7.

Whole the above describes the preferred embodiment of the invention it should be appreciated that variations may be made without departing from the scope of the invention which is intended to be limited only by the appended claims.

What is claimed is:

1. A combined comb and shoe horn comprising:

a spine having an inside and outside edge and a first and second set of two opposing depressions, aid depressions being disposed on opposite sides of said spine, each depression extending between the inside and outside edge of the spine, said first set of depressions diagonally angled from a point at the inside edge closer to the hoe horn to a point at the outside edge further from the shoe horn, and said second set of depressions diagonally angled from a point at the inside edge further from said shoe horn to a point at the outside edge closer to said shoe horn;

a row of substantially parallel teeth extending rom their base outwardly from the inside edge of said spine, one end of said spine leading into a top end tooth, said end tooth being the last tooth at one end of said row, the other end of said spine leading into a bottom end tooth at the other end of said row, the side of said bottom end tooth opposite said row of teeth, forming a smooth falciform arch, said falciform arch and the outside edge of said spine narrowing toward each other to form a neck segment; and a shoe horn shaped handle portion extending outwardly from said neck.

2. The invention of claim 1 wherein said shoe horn portion further comprises:

a plurality of substantially parallel elongate resilient teeth in arcuate array.

3. The invention of claim 1 wherein said depressions form grooves in which said angled placement defines an acute angle relative to an axis parallel to the direction in which said teeth extend.

4. The invention of claim 3 in which said acute angle is less than about 20 degrees.

5. A combined lift comb and shoe horn comprising:

a spine having an inside edge, an outside edge, and side edges;

a row of substantially parallel elongate teeth extending from their base outwardly from the inside edge of said spine, the last teeth on opposite ends of the row having outer surfaces opposite said row which outer surfaces are continuous with the side edges of the spine, said side edges of the spine curving inwardly toward each other forming a neck;

a plurality of depressions in said spine for gripping the invention, said depressions forming elongated grooves which are located adjacent the side of said spine; and a shoe horn shaped handle extending outwardly from said neck.

* * * * *